United States Patent [19]

Leveskis

[11] 4,250,048

[45] * Feb. 10, 1981

[54] METAL OXIDE REMOVER CONTAINING A STRONG MINERAL ACID, CHELATING AGENT AND A BASIC AMMONIA DERIVATIVE

[75] Inventor: Newton G. Leveskis, Auburn, Calif.

[73] Assignee: Custom Research and Development, Auburn, Calif.

[ * ] Notice: The portion of the term of this patent subsequent to Nov. 13, 1996, has been disclaimed.

[21] Appl. No.: 52,994

[22] Filed: Jul. 3, 1979

Related U.S. Application Data

[63] Continuation-in-part of Ser. No. 838,443, Sep. 30, 1977, Pat. No. 4,174,290, which is a continuation-in-part of Ser. No. 751,771, Dec. 16, 1976, abandoned.

[51] Int. Cl.[3] ..... C11D 7/32; C11D 7/26; C11D 7/08

[52] U.S. Cl. ..... 252/142; 134/3; 134/41

[58] Field of Search ..... 252/142, 148, 87, 544, 252/547, 548; 134/3, 41

[56] References Cited

U.S. PATENT DOCUMENTS

| | | | |
|---|---|---|---|
| 2,981,633 | 4/1961 | Davis et al. | 134/41 X |
| 3,072,502 | 1/1963 | Alfano | 134/3 |
| 3,349,043 | 10/1967 | Mannin g et al. | 252/407 |
| 3,806,459 | 4/1974 | Petrey | 252/180 X |
| 3,993,575 | 11/1976 | Howanitz et al. | 252/142 |
| 4,174,290 | 11/1979 | Leveskis | 252/142 |

*Primary Examiner*—Harris A. Pitlick
*Attorney, Agent, or Firm*—Townsend and Townsend

[57] ABSTRACT

Composition and method for removing metal oxides from ferrous metals. The composition contains an ammonia derivative such as an amine, a strong mineral acid and an organic chelating agent for the metal oxides in an aqueous solution having an acidic pH of about 0.5–3.0. Metal oxides are most readily removed by applying the solution at elevated temperature.

18 Claims, No Drawings

METAL OXIDE REMOVER CONTAINING A STRONG MINERAL ACID, CHELATING AGENT AND A BASIC AMMONIA DERIVATIVE

This application is a continuation-in-part of patent application Ser. No. 838,443 filed Sept. 30, 1977 (now U.S. Pat. No. 4,174,290), which in turn is a continuation-in-part of patent application Ser. No. 751,771 filed Dec. 16, 1976, now abandoned.

BACKGROUND OF THE INVENTION

1. Field of the Invention

This invention relates to a composition and method for removing metal oxides such as rust and mill scale from ferrous metals such as steel. More particularly, the invention relates to metal oxide removal from ferrous metals while avoiding corrosion and discoloration of the metal.

2. Description of the Prior Art

It is known to use citric acid and citrates for the removal of rust from ferrous metals, see for example U.S. Pat. No. 3,510,432. The disadvantage of such materials is that they leave a discoloration or black film on the rust-free metal.

Another reference teaching the use of citric acid is U.S. Pat. No. 3,492,238 which employs citric acid in combination with EDTA (ethylene diamine tetracetic acid). This reference employs the solution at a pH of about 6.0–7.0.

Triethanolamine has been employed in metal cleaning formulations as an inhibitor for acid attack on the metal substrate. It has been employed to avoid the blackening or discoloration of the cleaned metal. In this connection, reference is made to U.S. Pat. No. 1,723,923 which teaches the combination of triethanolamine in highly corrosive pickling baths such as cold concentrated sulphuric form or a heated more dilute form. Such pickling baths are corrosive to the plant in which they are used and present an ecologically unacceptable disposal problem.

U.S. Pat. No. 3,095,379 describes a metal cleaning composition which is the high temperature reaction product of citric acid and monoethanolamine. Such a formulation has been found to also leave an undesirable black coating on the cleaned metal surfaces.

Other references considered include the following: U.S. Pat. Nos. 2,006,216; 2,505,785; 2,994,664; 3,056,746; 3,282,848; 3,510,432; 3,589,859; and 3,779,935.

Attention is invited to the two parents of this application referenced above for the citation of additional prior art.

SUMMARY OF THE INVENTION

The present invention provides a formulation which leaves the ferrous metal surface substantially free of metal oxides and substantially free of discoloration such as the blackened condition formed by various of the prior art formulations. In addition, the present cleaning solution is essentially non-corrosive and does not attack either the metal being cleaned or the equipment utilized in the cleaning operation. It is thus highly acceptable from an ecological standpoint.

All of these advantages are accomplished with a composition comprising an aqueous solution containing a basic ammonia derivative selected from ammonium hydroxide and organic amines, an organic chelating agent for the metal oxides and a strong mineral acid, all of said components being present in effective concentrations to remove metal oxides from the metal to be cleaned in the absence of acid corrosion and discoloration thereof, the pH of said solution being about 0.5–3.0 and the weight ratio of said ammonia derivative to said chelating agent being about 2:7 to 7:2.

The chelating agent will usually contain two or more functional groups for chelating with the metal oxide, the functional groups being selected from acids (carboxyllic, sulfonic, phosphonic, and the like), hydroxyl, and amino. Suitable chelating agents are: citric acid, gluconic acid, tartaric acid, malic acid, ascorbic acid, hydroxyethanediphosphonicacid, diethylenetriaminepentaaceticacid and ethylenediaminetetraaceticacid. In general, to be effective the chelating agents should be soluble in the aqueous medium of the treating solution. Thus, an unsatisfactory chelating agent which is not soluble in the aqueous medium may be made soluble if the solution temperature is raised to the point where the chelating agent becomes soluble.

It will be appreciated that the components used will form ions in aqueous solution. Accordingly, equivalent results can be obtained by addition of the various components as salts which form the desired ions. For example, an amine citrate salt could be used to supply part of the citric acid and organic amine components.

It is essential to the efficient operation of the formulation that the pH and component ratios be maintained within the above limitations. In a preferred embodiment, the formulation pH is about 0.5–2.0, most preferably about 0.5–1.5. In all cases an effective amount of strong mineral acid to achieve clean surfaces should be present. A typical formulation for removing metal oxides from ferrous metals has the following formula in approximate parts by weight, said formula being adapted for use in a concentrate or for dilution with additional water: 30 water, 2–7 basic ammonia derivative, 7–2 citric acid, and at least about 0.25–0.5 of strong mineral acid, said formula having a pH of about 1–2.

The basic ammonia derivative employed will either be ammonium hydroxide or an organic amine. Any water soluble amine is contemplated including aliphatic and aromatic amines. Examples are alkyl amines, alkanol amines. The amine may be primary, secondary, tertiary or quaternary in structure.

As an optional additive the formulation may include an organic cationic corrosion inhibitor of the type designed to inhibit the attack of hydrochloric acid or sulphuric acid on ferrous metals.

Examples of some usable formulations in approximate parts by weight are next given. These formulas are adapted for use in the concentration shown or they may be diluted with additional water as desired and as will be illustrated in the working examples.

FORMULA A 64.0 Water
10.5 Triethanolamine
10.5 HCl Acid 20° BAUME
15.0 Citric Acid

FORMULA B 64.0 Water
10.5 Triethanolamine
10.5 $H_2SO_4$—66° BAUME
15.0 Citric Acid Where an optical organic cationic corrosion inhibitor is desired it may be added to the above formulas in the amount of about 1 ounce per gallon of the formulation. For example, in Formula A a suitable additive is the commercial corrosion inhibitor available from Amchem Products Inc. and offered under the trade name "Rodine 213". With respect to Formula B, an appropriate corrosion inhibitor for sulfuric acid available from the same company is known as "Rodine 92A".

The above Formulas A and B are believed to be useful formulations and concentrations for many applications. It will be appreciated that the precise concentration of the components is subject to some variation from that shown in the formulas. It is contemplated that each of the components may vary by as much as ±20% from the figure shown, provided that the final formulation is operative to remove metal oxides without corroding and discoloring the metal to be cleaned. The following Table I will illustrate the effectiveness of the above type of formulations (the formulations of Table I do not contain corrosion inhibitors) in ability to remove metal oxides while leaving the metal clean and free from corrosion and discoloration. Data was obtained by the following procedure.

7 g of the citric acid in 30 g of water was neutralized by the following materials: triethanolamine, diethanolamine, monoethanolamine and ammonia. The pH was adjusted to 3.5 with concentrated HCl. DEX and the material from U.S. Pat. No. 3,510,432 were purchased, while U.S. Pat. No. 3,095,379 was followed to produce Example I and Example A. Citric acid was run straight in water (7 g in 30 g water). All examples were placed in 100 ml beakers filled to the 30 ml mark and pieces (½"×2") of rusty 18 gauge 1020 cold rolled steel placed in them. The results at room temperature and 210° F. are shown in Table I.

TABLE I

| | Formulation This Invention | Citric Acid Alone | Diethanolamine + Citric Acid pH 3.5 | Monoethanolamine + Citric Acid pH 3.5 | $NH_3$ + Citric Acid pH 3.5 | DEX[1] | U.S. Pat. No. 3,510,432 Ex. #1 (full strength) | U.S. Pat. No. 3,510,432 Ex. #1 20:1 w/HOH | U.S. Pat. No. 3,095,379 Exs. #1 Plus A |
|---|---|---|---|---|---|---|---|---|---|
| Time: 1 Hour Temp: Room Degree of Rust Removal: | All | All | All | All | All | All | All | All | All |
| Time: 1 Hour Temp: Room Color: | Shiny Bright | Gray/ Yellow | Lt. Gray | Dark Gray | Gray/ Yellow | Black | Black | Gray | Black |
| Time: 24 Hours Temp: Room Color: | Shiny Bright | Gray/ yellow | Gray | Dark Gray | Dark Gray | Black | Black | Gray | Black |
| Time: 3 Minutes Temp: 210° F. (99° C.) Degree of Rust Removal: | All | All | All | Small Amt. Left | All | Small Amt. Left | All | Small Amt. Left | All |
| Time: 3 Minutes Temp: 210° F. (99° C.) Color: | Bright | Yellow/ Gray | Gray | Gray | Lt./Gray Yellow | Black | Black | Dark Gray | Black |

[1]Commercially available formulation for removing rust, precise composition unknown.

The formulations of this invention were tested in a commercial operation in which rusty 55 gallon drums were being cleaned. In this operation the cleaning solution was applied to the drums by spraying with a nozzle at a pressure of 60 psi. For rapid operations it is desirable to employ the cleaning solution at an elevated temperature, for example at about 120°-212° F. (49°-100° C.) to shorten treatment time. To be acceptable in this test operation it was considered that all rust should be removed with the spray within 3 minutes while the cleaned wet drums should not re-rust within 30 minutes. As will be seen, the present formulations met these conditions.

In this test 30 gallons each of Formulas A and B listed above were used, including the optional applicable Rodine corrosion inhibitors in the amounts of 1 ounce per gallon of solution. The concentrates of Formulas A and B were diluted for use with water in the amount by volume shown in the example below. After spraying with the metal oxide remover solution, a rinse was applied as indicated. The results are as follows.

TABLE II

| Test No. | Water Dilution | Temperature | Time | Rust Removal | Rinse |
|---|---|---|---|---|---|
| | | | Formula A (HCl) | | |
| 1 | 4 to 1 | 60° F. (15.6° C.) | 4 min. | About ½ Rust Removed | Water Alone Re-rusted |
| 2 | 4 to 1 | 160° F. (71° C.) | 3 min. | Most Rust Removed | Water Alone Re-rusted |
| 3 | 4 to 1 | 160° F. (71° C.) | 3 min. | All Rust Removed | Water Alone Re-rusted |
| 4 | 4 to 1 | 212° F. (100° C.) | 3 min. | All Rust Removed | Water + 1% $NaNO_2$ Did Not Re-rust |
| | | | Formula B ($H_2SO_4$) | | |
| 1 | 4 to 1 | 60° F. (15.6° C.) | 3 min. | About ½ Rust Removed | In Water, 1½% Citric Acid Neutralized w/ |

TABLE II-continued

| Test No. | Water Dilution | Temperature | Time | Rust Removal | Rinse |
|---|---|---|---|---|---|
| | | | | | triethanolamine |
| 2 | 4 to 1 | 160° F. (71° C.) | 3 min. | Most Rust Removed | Tan Color<br>1% $NaNO_2$ in Water<br>Tan Streaks |
| 3 | 4 to 1 | 212° F. (100° C.) | 3 min. | All Rust Removed | .31% Alox[1] 1843<br>Did Not Re-rust |
| 4 | 8 to 1 | 212° F. (100° C.) | 3 min. | All Rust Removed | .31% Alox 1843<br>Did Not re-rust |

[1]Trademark for a series of oxygenated hydrocarbons derived from the controlled, liquid phase, partial oxidation of petroleum fractions. Each consists of mixtures of organic acids and hydroxy acids, lactones, esters, and unsaponifiable matter.

To illustrate the criticality of weight ratio of the ammonia derivative to the citric acid in the formula, the following experimental work was performed.

EXAMPLE 1

A series of solutions were prepared in 100 ml beakers, each beaker contained the amounts shown in the Table below. In each case the beaker contained 30 g of water and the contents were adjusted to a pH of 1.5 with the addition of HCl. 1×1 square inch pieces of rusty drum steel were placed in the solutions at boiling temperatures of approximately 212° F. (100° C.) for 3 minutes. The results are shown in Table III. The first number at the head of each column refers to the amount of amine utilized and the number on the right at the head of each column refers to the amount of citric acid.

TABLE III

| In Grams | 0 to 7 | 1 to 7 | 2 to 7 | 3 to 5 | 4 to 4 | 5 to 3 | 7 to 2 | 7 to 1 | 7 to 0 | In Grams |
|---|---|---|---|---|---|---|---|---|---|---|
| Monoethanolamine | – | – | + | + | ++ | + | + | – | – | Citric Acid |
| Diethanolamine | – | – | + | + | + | + | + | – | – | Citric Acid |
| Triethanolamine | – | – | ++ | ++ | ++ | ++ | + | – | = | Citric Acid |
| Hyamine 3500[1] 80% | – | + | ++ | ++ | ++ | ++ | ++ | ++ | ++ Rusty | Citric Acid |
| Triethylamine | – | – | + | + | + | + | + | – | – | Citric Acid |
| $NH_4OH$ 28% | – | –* | –* | ++ | ++ | ++ | + | – | – | Citric Acid |
| Triisopropanol-amine | – | – | + | ++ | ++ | + | + | – | = | Citric Acid |
| Adogen 471[2] | – | + | ++ | ++ | ++ | ++ | ++ | ++ | ++ Rusty | Citric Acid |
| Verox 375[3] amine oxide | – | – | + | + | + | + | + | – | = | Citric Acid |
| Monoethylamine | – | – | + | + | ++ | + | + | – | – | Citric Acid |

+ indicates Bright
++ indicates Bright and Shiny
– indicates Gray
= indicates Dark Gray
[1]Inert ingredient: ethyl alcohol (20%) Active ingredient: (80% concentrate) n-alkyl (50% $C_{14}$, 40% $C_{12}$, 10% $C_{16}$) dimethyl benzyl ammonium chloride. Rohm and Haas Company
[2]Tallow trimethyl ammonium chloride - Ashland Chemical Company
[3]Dimethyl coco amine oxide - Ashland Chemical Company
*Data obtained with ammonium chloride It will be observed that Hyamine 3500 was utilized as an 80% solution. Accordingly, the amount of active ingredient is somewhat different than the ratios indicated at the tops of the columns. The results with this particular and preferred quaternary amine point up the fact that the weight ratio does not have a sharp dividing line at the lower and upper limits. The weight ratios indicated throughout this specification should be taken as being approximate ratios subject to some variation on the order of ±20% as previously discussed in connection with Formulas A and B.

EXAMPLE 2

This example will illustrate the criticality of the pH in the formulations.

Solutions were made up using the amounts shown in Table IV. 100 ml beakers were used. 1×1 inch (approximate) pieces of rusty drum steel were placed in boiling solutions at approximately 212° F. (100° C.) for 3 minutes. The results are shown as follows.

TABLE IV

| | pH 5 | pH 4 | pH 3 | pH 2 |
|---|---|---|---|---|
| 7g triethanolamine<br>30g HOH<br>Enough citric acid to give pH shown | – | – | = | |
| 7g triethanolamine<br>30g HOH<br>5g citric acid<br>Enough con. HCl for given pH | – | ± | + | + |
| 5g monoethanolamine<br>30g HOH<br>Enough citric acid to give pH shown | – | – | – | |
| 5g monoethanolamine<br>7g citric acid<br>30 g HOH<br>Enough HCl to give pH shown | – | – | ++ | ++ |
| 5g $NH_4OH$ con.<br>7 g citric acid<br>Enough HCl to give pH shown | = | – | + | + |

+ indicates Bright
++ indicates Bright and Shiny
– indicates Gray
= indicates Dark Gray
con. indicates concentrated

EXAMPLE 3

This example will illustrate the requirement of the presence of a minimum amount of strong mineral acid in order to obtain the desired results. In particular, about 0.25–0.5 g or more of strong mineral acid is required in a concentrate formulation containing 30 g of water and the weight ratios of the other components shown in Example 1. This point was established as follows.

In a 100 ml beaker 7 g of citric acid was added followed by 30 g of HOH. Enough triethanolamine was added to give a pH of 3 (3.5 g approximately). A piece of 1"×1" rusty drum steel was added to the boiling material for 3 minutes. The result was recorded at "A" below. Water was then added to replace the amount boiled out and 0.25 g of concentrated HCl added followed by enough triethanolamine to adjust the pH to 3. Again a rusty 1"×1" piece of drum steel was added to the boiling solution for 3 minutes. "B" was the result. Finally after adding lost water, 0.5 g of concentrated HCl was added and enough triethanolamine to bring the pH back to 3. As before a 1"×1" rusty piece of drum steel was added to the boiling solution for 3 minutes. The result was recorded at "C".

| A | B | C |
|---|---|---|
| Dark Gray Mottled and Streaked | Gray No Streaks | Bright |

EXAMPLE 4

This example illustrates that any strong mineral acid may be utilized. The procedure followed was similar to Example 3. Thus, four solutions were made up in 100 ml beakers. Each beaker contained: 7 g citric acid, 3.5 g triethanolamine, 30 g HOH. The pH was 3.

In the first instance no strong mineral was added. In the other three beakers concentrated mineral acids as indicated were added and additional triethanolamine was thereafter added to bring the pH back to 3. In each case a 1"×1" sample of rsuty drum steel was treated for 3 minutes at boiling temperature. The results were as follows:

| 1 | 2 | 3 | 4 |
|---|---|---|---|
| None Dark Gray Streaked | HCl 37% Bright | $H_2SO_4$ con. Bright | $H_3PO_4$ 85% Bright |

With respect to the amounts of mineral acid added, reference has been made to the minimum of 0.25–0.5 g. This amount refers to the usually encountered concentrated form of the acid. For example, in the case of HCl the concentrated solution is 37% in strength. 0.25–0.5 g of this concentrate is the minimum amount referred to. Similarly, in the case of phosphoric acid the 0.25–0.5 g refers to the 85% concentrate of phosphoric acid and 98% with respect to sulfuric acid.

The foregoing Examples 1–4 utilize the preferred metal oxide chelating agent citric acid. The following examples will illustrate the use of other metal oxide chelating agents within the scope of this invention. In general, satisfactory chelating agents will be soluble in the aqueous formulation under the conditions of use which will usually be at a temperature of about 120°–212° F. (49°–100° C.) to accelerate the metal oxide removal process.

EXAMPLE 5

In a 100 ml beaker there was introduced 7 g of a chelating agent listed in the Table below, followed by 55 g of water. To this, 5 g of an amine (either triethanol amine or Hyamine 3500) was added. After mixing, the pH was adjusted to 0.80. The temperature was raised to 92° C. and a cut strip (1"×6") of hot band mild steel was placed into the beaker. Temperature was controlled between 87° C. to 92° C. for a period of either 10 or 30 minutes. The results are tabulated in Table V below. The acid used to adjust the pH was hydrochloric acid (31%).

TABLE V

| | 10 Minutes, 87° C. to 92° C. | | 30 Minutes, 87° C. to 92° C. | |
|---|---|---|---|---|
| Chelating Agent and Amine | Mill Scale Removal | Color | Mill Scale Removal | Color |
| Citric Acid, Triethanol Amine | All | Gray Metallic | All | Gray Metallic |
| Gluconic Acid, Triethanol Amine | All | Gray Metallic | All | Gray Metallic |
| Tartaric Acid, Triethanol Amine | All | Gray Metallic | All | Gray Metallic |
| Malic Acid, Triethanol Amine | All | Gray Metallic | All | Gray Metallic |
| Ascorbic Acid, Triethanol Amine | All | Gray Metallic | All | Gray Metallic |
| Hydroxyethanediphosphonicacid, Triethanol Amine | All | Light Gray Metallic | All | Light Gray Metallic |
| Diethylenetriaminepentaaceticacid, Triethanol Amine | All | Light Gray Metallic | All | Light Gray Metallic |
| Ethylenediaminetetraceticacid, Triethanol Amine | All | Light Gray Metallic | All | Light Gray Metallic |
| Malic Acid, Hyamine 3500 | All | Metallic | All | Metallic |
| Tartaric Acid, Hyamine 3500 | All | Metallic | All | Metallic |
| Nitrilotriacetic Acid, Triethanol Amine | Very Little | Black | Very Little | Black |
| Anthranilic Acid*, Triethanol Amine | Very Little | Black | Very Little | Black |
| Trans-1,2-Dimino Cyclohexane Tetraacetic Acid*, Triethanol Amine | Very Little | Black | Very Little | Black |
| Squire U.S. Pat. No. 3,510,432, Example #1 pH 4.5, Not Diluted | Some Left | Mottled; Dark Gray, Gray Metallic | All | Mottled; Dark Gray, Gray Metallic |

*These chelating agents were not soluble in the reaction medium.

EXAMPLE 6

One individual experiment was run as in Example 5 but with 7 g of gluconic acid (50% in $H_2O$) and 5 g of triethanol amine in 55 g of water. However, this time the pH was adjusted to 3.5 with aqueous hydrochloric acid. The results:

After 10 minutes, 92° C. to 87° C.—Black, very little mill scale removed;

After 30 minutes, 92° C. to 87° C.—Black, very little mill scale removed.

EXAMPLE 7

Solutions were made up following the same procedure as Example 5. However, this time room temperature was used instead of 92° C. to 87° C. Results appear below in Table VI.

TABLE VI

| Chelating Agent and Amine | 4 Hours at Room Temp. ~25° C. Mill Scale Removed |
|---|---|
| Malic Acid, Hyamine 3500 | All Removed* |
| Gluconic Acid, Triethanol Amine | All Removed |
| Tartaric Acid, Triethanol Amine | All Removed |
| Malic Acid, Triethanol Amine | All Removed |
| Hydroxyethanediphosphonicacid, Triethanol Amine | All Removed |
| Diethylenetriaminepentaacetic-acid, Triethanol Amine | Very Little Removed** |
| Squire U.S. Pat. No. 3,510,432, Example 1, pH 4.5 | Some Mill Scale Left |

*Mill scale was completely removed in 2 hours, as compared to about 4 hours for the rest of the samples.

**This chelating agent worked well in Example 5 at 92° C. to 87° C. in which it was soluble. At room temperature almost all of the chelating agent crystallized out. This shows the importance of solubility of the chelating agent in the reaction medium.

I claim:

1. A composition for removing metal oxides from ferrous metals comprising: an aqueous solution containing a basic ammonia derivative selected from ammonium hydroxide and organic amines, an organic chelating agent for the metal oxides other than citric acid and a strong mineral acid, all of said components being present in effective concentrations to remove metal oxides from the metal to be cleaned in the absence of acid corrosion and discoloration thereof, the pH of said solution being about 0.5–3.0 and the weight ratio of said ammonia derivative to said chelating agent being about 2:7 to 7:2.

2. A composition for removing metal oxides from ferrous metals in accordance with claim 1, wherein the pH of said solution is about 1.0–2.0.

3. A composition for removing metal oxides from ferrous metals in accordance with claim 1, wherein the pH of said solution is about 0.5–1.5.

4. A composition for removing metal oxides from ferrous metals in accordance with claim 1, wherein said ammonia derivative is ammonium hydroxide.

5. A composition for removing metal oxides from ferrous metals in accordance with claim 1, wherein said ammonia derivative is an aqueous soluble amine.

6. A composition for removing metal oxides from ferrous metals in accordance with claim 5, wherein said aqueous soluble amine is selected from alkyl amines and alkanol amines.

7. A composition for removing metal oxides from ferrous metals in accordance with claim 5, wherein said aqueous soluble amine is a quaternary amine.

8. A composition for removing metal oxides from ferrous metals in accordance with claim 7, wherein said quaternary amine is an 80% solution in ethanol of n-alkyl dimethyl benzyl ammonium chloride.

9. A composition for removing metal oxides from ferrous metals in accordance with claim 1 wherein said chelating agent contains two or more functional groups selected from acid, hydroxyl and amino.

10. A composition for removing metal oxides from ferrous metals in accordance with claim 5 wherein said chelating agent is soluble in the aqueous media of said composition.

11. A composition for removing metal oxides from ferrous metals in accordance with claim 10 said composition has a temperature of about 120°–212° F. (49°–100° C.).

12. A composition for removing metal oxides from ferrous metals in accordanec with claim 5 wherein said chelating agent is gluconic acid.

13. A composition for removing metal oxides from ferrous metals in accordance with claim 5 wherein said chelating agent is tartaric acid.

14. A composition for removing metal oxides from ferrous metals in accordance with claim 5 wherein said chelating agent is malic acid.

15. A composition for removing metal oxides from ferrous metals in accordance with claim 5 wherein said chelating agent is ascorbic acid.

16. A composition for removing oxides from ferrous metals in accordance with claim 5 wherein said chelating agent is hydroxyethanediphosphonic acid.

17. A composition for removing metal oxides from ferrous metals in accordance with claim 5 wherein said chelating agent is diethylenetriaminepentaacetic acid.

18. A composition for removing metal oxides from ferrous metals in accordance with claim 5 wherein said chelating agent is ethylenediaminetetraacetic acid.

* * * * *